United States Patent [19]

Fey et al.

[11] Patent Number: 4,879,142

[45] Date of Patent: Nov. 7, 1989

[54] PROCESS FOR PREPARING A SILICON CARBIDE PROTECTIVE COATING

[75] Inventors: Volker Fey; Bernd Pachaly; Norbert Zeller, all of Burghausen, Fed. Rep. of Germany

[73] Assignee: Wacker-Chemie GmbH, Munich, Fed. Rep. of Germany

[21] Appl. No.: 158,813

[22] Filed: Feb. 22, 1988

[30] Foreign Application Priority Data

Mar. 6, 1987 [DE] Fed. Rep. of Germany ..... 3707224

[51] Int. Cl.[4] ..... B05D 3/02

[52] U.S. Cl. ..... 427/227; 427/294; 427/377

[58] Field of Search ..... 427/227, 294, 377

[56] References Cited

U.S. PATENT DOCUMENTS

| | | | |
|---|---|---|---|
| 4,267,211 | 5/1981 | Yajima et al. | 427/228 |
| 4,418,097 | 11/1983 | Misra | 427/226 |
| 4,696,827 | 9/1987 | Okamura et al. | 427/228 |

*Primary Examiner*—Janyce Bell

[57] ABSTRACT

A process for preparing a protective coating which comprises applying a copolymer obtained by reacting at least one disilane of the formula $$R_2R^1Si_2(OCH_3)_3$$

in which R represents the same or different alkyl, alkenyl or aryl radicals and $R^1$ represents the same or different alkyl radicals, which may optionally be mixed with a compound of the formula $$R_2Si_2(OCh_3)_4$$

in which R is the same as above, with at least one compound of the formula $$R_2R^2SiH$$

in which R is the same as above and $R^2$ represents a methoxy radical or is the same as R, in the presence of at least one compound of the formula $$MOR$$

in which R is the same as above and M represents an alkali metal, and a compound of the formula $$HO\text{-}[(R^1R^3SiO)_x(R_2{}^1SiO)_y]_nH$$

in which $R^1$ is the same as above, $R^3$ represents the same or different alkenyl radicals, x is in the range of from 0.5 to 1.5, y is in the range of from 3 to 5 and n is in the range of from 500 to 2,000, to a substrate and thereafter heating the coated substrate in an inert atmosphere or in vacuo at temperatures in the range of from 700° to 1,400° C.

5 Claims, No Drawings

PROCESS FOR PREPARING A SILICON CARBIDE PROTECTIVE COATING

The present invention relates to silicon carbide coatings and more particularly to a process for preparing silicon carbide protective coatings.

BACKGROUND OF THE INVENTION

Silicon carbide ceramic materials are well known in the art and a process for preparing the same is described, for example, in U. S. Pat. No. Re. 31,447 to Baney et al, in which a polysilane having from 0 to 60 mole percent of $(CH_3)_2Si$ units, from 40 to 100 mole percent of $CH_3Si$ units and also bonded to the silicon atoms are radicals of the formula RO—, where R is an alkyl radical of from 1 to 4 carbon atoms or a phenyl radical, is applied as a coating to a substrate and heated in an inert atmosphere or in vacuo to a temperature of from 1200° C. to 1600° C. to form a silicon carbide-containing ceramic.

It is an object of the present invention to provide a process for preparing protective coatings containing silicon carbide. Another object of the present invention is to provide a process for preparing thermally stable silicon carbide coatings on metallic and non-metallic substrates. Still another object of the present invention is to provide a process for preparing chemically stable silicon carbide coatings on metallic and non-metallic substrates. A further object of the present invention is to provide silicon carbide protective coatings on metallic and non-metallic substrates which are thermally and chemically stable.

SUMMARY OF THE INVENTION

The foregoing objects and others which will become apparent from the following description are accomplished in accordance with this invention, generally speaking, by providing a process for preparing protective coatings containing silicon carbide which comprises applying a copolymer obtained by reacting at least one disilane of the formula $$R_2R^1Si_2(OCH_3)_3$$

in which $R^1$ represents the same or different alkyl, alkenyl or aryl radicals and $R^1$ represents the same or different monovalent alkyl radicals, which may optionally be mixed with a compound of the formula $$R_2Si_2(OCH_3)_4$$

in which R is the same as above, with at least one compound of the formula $$R_2R^2SiH$$

in which R is the same as above and $R^2$ represents a methoxy group or is the same as R, in the presence of at least one compound of the formula $$MOR$$

in which R is the same as above and M represents an alkali metal, and a compound of the formula $$HO\text{-}[(R^1R^3SiO)_x(R_2{}^1SiO)_y]_nH$$

in which $R_1$ is the same as above, $R^3$ represents the same or different alkenyl radicals, x is in the range of from 0.5 to 1.5, y is in the range of from 3 to 5 and n is within the range of from 500 to 2,000, to a substrate and thereafter reacting the coating under an inert atmosphere or in vacuo at temperatures in the range of from 700° to 1,400° C.

In a preferred embodiment of this invention, the process comprises mixing the copolymer obtained by reacting at least one disilane of the formula $$R_2R^1Si_2(OCH_3)_3$$

in which R is the same or different alkyl, alkenyl or aryl radicals and $R^1$ represents the same or different alkyl radicals, which may optionally be mixed with a compound of the formula $$R_2Si_2(OCH_3)_4$$

in which R is the same as above, with at least one compound of the formula $$R_2R^2SiH$$

in which R is the same as above, and $R^2$ is a methoxy group or is the same as R, in the presence of at least one compound of the formula $$MOR$$

in which R is the same as above and M is an alkali metal, a compound of the formula $$HO\text{-}[(R^1R^3SiO)_x(R_2{}^1SiO)_y]_nH$$

in which $R^1$ is the same as above, $R^3$ is the same or different alkenyl radicals, x is in the range of from 0.5 to 1.5, y is in the range of from 3 to 5 and n is in the range of from 500 to 2,000 and a compound of the formula $$[(R_3{}^1SiO)_a(R_2{}^1R^3SiO)_b(SiO_2)_c]_d$$

in which $R^1$ and $R^3$ are the same as above, a is in the range of from 0.3 to 0.4, b is in the range of from 0.01 to 0.1, c is in the range of from 0.5 to 0.7 and d is in the range of from 10 to 100, with silicon carbide having an average particle size distribution of from 0.5 to 10 $\mu$m, coating a substrate to be protected with the mixture and thereafter heating the coated substrate under an inert atmosphere or in vacuo at temperatures in the range of from 700° to 1,400° C.

DESCRIPTION OF THE INVENTION

The copolymer of this invention is obtained by reacting at least one disilane of the formula $$R_2R^1Si_2(OCH_3)_3$$

which may be optionally mixed with a compound of the formula $$R_2Si_2(OCH_3)_4$$

with at least one compound of the formula $R_2R^2SiH$ in the presence of at least one compound of the formula

MOR a compound of the formula $HO[(R^1R^3SiO)_x(R_2{}^1SiO)_y]_nH$ and optionally a compound of the formula $[(R_3{}^1SiO)_a(R_2{}^1R^3SiO)_b(SiO_2)_c]_d$ where R is an alkyl, alkenyl or aryl radical, $R^1$ is an alkyl radical, $R^2$ is a methoxy radical or R, $R^3$ is an alkenyl radical, M is an alkali metal, a is from 0.3 to 0.4, b is from 0.01 to 0.1, c is from 0.5 to 0.7, d is from 10 to 100, n is from 500 to 2,000, x is from 0.5 to 1.5 and y is from 3 to 5.

The alkyl groups represented by R, $R^1$ and $R^2$ each preferably contain from 1 to 12 carbon atoms per radical, such as the methyl, ethyl, n-propyl, isopropyl, n-butyl, sec-butyl, 2-ethylhexyl and dodecyl radicals. Examples of aryl radicals represented by R and $R^2$ are the phenyl radical and xenyl radical. The preferred alkyl radicals represented by R, $R^1$ and $R^2$ are methyl radicals because of their availability. A preferred example of an alkenyl radical represented by R or $R^3$ is the vinyl radical.

The tert-butyl radical may be mentioned as a preferred example of a radical represented by R in the compound of the formula

MOR

The alkali metal can be lithium, sodium, potassium, rubidium or cesium. Sodium and potassium are the preferred alkali metals in the compound of the formula

MOR.

Examples of preferred disilanes are 1,1,2-trimethyl1,2,2-trimethoxydisilane, 1-phenyl-1,2-dimethyl-1,2,2-trimethoxydisilane and 1-vinyl-1,2-dimethyl-1,2,2-trimethoxydisilane. A preferred example of a compound of the formula $R_2Si_2(OCH_3)_4$ is 1,2-dimethyl-1,1,2,2-tetramethoxydisilane.

The preparation of such silanes is known and described by, for example, E. Hengge et al in "Monatshefte für Chemie" Volume 105, (1974), pages 671 to 683; W. H. Atwell et al in "Journal of Organometallic Chemistry", Volume 7, (1967), pages 71 to 78, E. Hengge et al in "Monatshefte für Chemie", Volume 99, (1968), pages 340 to 346, and H. Watanabe et al in "Journal of Organometallic Chemistry", Volume 128 (1977), pages 173 to 175.

If disilanes of the formula $R_2Si_2(OCH_3)_4$ are also used, they are preferably employed in an amount of from 0.5 to 1.5 mols per mol of disilane of the formula $R_2R^1Si_2(OCH_3)_3$.

Examples of preferred compounds of the formula $R_2R^2SiH$ which are employed are dimethylmethoxysilane and diphenylmethylsilane.

The compound of the formula $R_2R^2SiH$ is preferably used in an amount of from 0.5 to 5 percent by weight, and more preferably from 2 to 4 percent by weight, based on the weight of the disilanes.

Preferred examples of compounds of the formula

MOR are sodium methylate and potassium tert-butylate.

A compound of the formula

MOR is used as a catalyst and is preferably employed in an amount of from 0.2 to 0.5 percent by weight based on the weight of the disilanes.

In the preferred compounds.of the formula $HO\text{-}(R^1R^3SiO)_x(R_2SiO)_y\text{-}_nH$, $R^1$ is a methyl radical, $R^3$ is a vinyl radical, x is in the range of from 0.5 to 1.5, y is in the range of from 3 to 5 and n is in the range of from 500 to 2,000.

The preparation of such compounds is well known and is described by, for example, W. Noll, in Chemistry and Technology of Silicones, Academic Press, Inc., London 1968.

About 0.1 to 10 percent by weight, and more preferably from 1 to 5 percent by weight of the compound of the formula $HO\text{-}(R^1R^3SiO)_x(R_2{}^1SiO)_y\text{-}_nH$ based on the weight of the disilanes is preferably added in the process of this invention.

The reaction of at least one disilane of the formula $R_2R^1Si_2(OCH_3)_3$ in which R represents the same or different monovalent alkyl, alkenyl or aryl radicals and $R^1$ represents the same or different monovalent alkyl group, which may optionally be mixed with a compound of the formula $R_2Si_2(OCH_3)_4$ in which R is the same as above, with at least one compound of the formula $R_2R^2SiH$ in which R is the same as above and $R^2$ represents the methoxy group or is the same as R, in the presence of at least one compound of the formula

MOR in which R is the same as above and M represents an alkali metal, and a compound of the formula $$HO\text{-}[(R^1R^3SiO)_x(R_2{}^1SiO)_y]_nH$$

in which $R^1$ is the same as above, $R^3$ represents the same or different alkenyl groups, x is in the range of from 0.5 to 1.5, y is in the range of from 3 to 5 and n is in the range of from 500 to 2,000, is carried out after the reactants and the catalyst have been mixed at temperatures of preferably from 25° to 220° C., and is discontinued when no further monomeric organomethoxysilane is distilled off. This reaction is preferably carried out under the pressure of the surrounding atmosphere, that is to say under 1,020 hPa (absolute) or about 1,020 hPa (absolute).

In the preferred compounds of the formula $$[(R_3{}^1SiO)_a(R_2{}^1R^3SiO)_b(SiO_2)_c]_d$$

$R^1$ is a methyl radical, $R^3$ is a vinyl radical, a is in the range of from 0.3 to 0.4, b is in the range of from 0.01 to 0.1, c is in the range of from 0.5 to 0.7 and d is in the range of from 10 to 100.

The preparation of these compounds is well known and is described, for example, by W. Noll, in Chemistry and Technology of Silicones, Academic Press, Inc., London 1968.

About 0.1 to 10 percent by weight, and more preferably from 3 to 5 percent by weight of the compound of the formula $$[(R_3{}^1SiO)_a(R_2{}^1R^3SiO)_b(SiO_2)_c]_d$$

is preferably added, based on the weight of the disilanes employed

Silicon carbide having an average particle size distribution in the range of from about 0.5 to 10 μm, and more preferably from 0.8 to 2 μm, is preferably employed. About 10 to 30 percent by weight, and more preferably from 15 to 20 percent by weight of silicon carbide is employed, based on the weight of the disilanes.

The preparation of a protective coating containing silicon carbide from a copolymer obtained by reacting at least one disilane of the formula $$R_2R^1Si_2(OCH_3)_3$$

in which R is the same or different alkyl, alkenyl or aryl radical and $R_1$ is the same or different alkyl radical, which may optionally be mixed with a compound of the formula $$R_2Si_2(OCH_3)_4$$

in which R is the same as above, with at least one compound of the formula $$R_2R^2SiH$$

in which R is the same as above and $R^2$ represents a methoxy radical or is the same as R, in the presence of at least one compound of the formula

MOR in which R is the same as above and M represents an alkali metal, and a compound of the formula $$HO\text{-}[(R^1R^3SiO)_x(R_2{}^1SiO)_y]_nH$$

in which $R^1$ the same as above, $R^3$ represents the same or different alkenyl groups, x is in the range of from 0.5 to 1.5, y is in the range of from 3 to 5 and n is in the range of from 500 to 2,000, and if desired, with a compound of the formula $$[(R_3{}^1SiO)_a(R_2{}^1R^3SiO)_b(SiO_2)_c]_d$$

in which $R^1$ and $R^3$ are the same as above, a is in the range of from 0.3 to 0.4, b is in the range of from 0.01 to 0.1, c is in the range of from 0.5 to 0.7 and d is in the range of from 10 to 100, and silicon carbide with an average particle size range of from 0.5 to 10 μm, is preferably carried out in the presence of an organic solvent Preferred examples of such solvents are organic, aromatic or aliphatic hydrocarbons.

Preferred solvents are toluene, petroleum ether of various boiling fractions or butyl acetate.

The coating of this invention can be applied in any manner suitable for applying liquid or paste-like substances to substrates, for example, by dipping, spraying, brushing, casting or rolling. After the coating has been applied, it is preferably dried at temperatures of from 10° to 100° C. in air for from 15 to 60 minutes and then reacted at temperatures of from 700° to 1,400° C., and more preferably from 900° to 1,100° C., under an inert atmosphere, such as that formed by blanketing with inert gasses, such as argon or nitrogen, or in vacuo.

The protective coatings of this invention, preferably have a thickness of from 5 to 2,000 μm, and more preferably from 10 to 50 μm.

The protective coatings of this invention are used, in particular, for producing thermally and chemically stable surface coatings on metals, ceramics, glass ceramics, fiber materials and carbon. The protection of carbon fiber-reinforced carbon (CFC) from oxidation, the surface sealing of porous ceramics or fiber materials and the protection of metals from corrosion are of particular importance.

Example 1

Preparation of the copolymer

A mixture containing 120 g (0.57 mol) of 1,2-dimethyl-1,1,2,2-tetramethoxydisilane, 180 g (0.98 mol) of 1,1,2-trimethyl-1,2,2-trimethoxydisilane, 8.1 g (2.7 percent by weight, based on the total weight of the disilanes) of dimethylmethoxysilane and 12 g of a vinylsiloxane of the formula $$HO\text{-}[(ViMeSiO)\ (Me_2SiO)]_nH$$

having an average molecular weight of 125,000 g/mol was heated rapidly from 25° to 90° C. after the addition of 1.2 g (0.4 percent by weight, based on the total weight of the disilanes) of sodium methylate. The mixture was then heated to 200° C., whereupon 223 g of a mixture containing dimethyldimethoxysilane and methyltrimethoxysilane were distilled off. About 98 g of residue was obtained. The residue was dissolved in 86 g of toluene and the resultant solution was passed through a thin film evaporator at 250° C. and at 5 mbar to remove the solvent and the oligomers. About 72 g of a copolymer having an average molecular weight of 1,800 g/mol were obtained.

EXAMPLE 2

Preparation of a silicon carbide on carbon fiber-reinforced carbon (CFC)

About 14.9 g of a 50 percent solution of the copolymer from Example 1 in toluene, 2.7 g of a 52 percent vinyl-waterglass resin solution in toluene, 4.0 g of toluene and 17.1 g of silicon carbide powder were stirred vigorously. A small test rod of 100×10×5 mm of CFC was brushed with this composition. After 30 minutes, the coating was tack-free. The small rod was heated up to 1,000° C. in a tubular oven, while blanketed with argon, and was kept at this temperature for 1 hour. After cooling, a uniform, crack-free coating of silicon carbide had formed on the small rod. The small test rod showed no weight loss after 4 hours at 1,000° C. in air.

What is claimed is:

1. A process for preparing a protective coating containing silicon carbide, which comprises applying a coating composition containing a copolymer obtained by reacting at least one disilane of the formula $$R_2R^1Si_2(OCH_3)_3$$

in which R is selected from the group consisting of alkyl, alkenyl, aryl radicals and mixtures thereof and $R^1$ is an alkyl radical with at least one compound of the formula $$R_2R^2SiH$$

in which R is the same as above and $R^2$ is selected from the group consisting of a methoxy radical and R, in the presence of at least one compound of the formula $$MOR$$

in which R is the same as above and M is an alkali metal, and a compoud of the formula $$HO[(R^1R^3SiO)_x(R^1{}_2SiO)_y]_nH$$

in which $R^1$ is the same as above, $R^3$ is an alkenyl radical, x is in the range of from 0.5 to 1.5, y is in the range of from 3 to 5 and n is in the range of from 500 to 2,000, to a substrate and thereafter pyrolyzing the coating in an inert atmosphere or in vacuo.

2. The process of claim 1, wherein the disilane of the formula $$R_2R^1Si_2(OCH_3)_3$$

in which R is selected from the group consisting of alkyl, alkenyl, aryl radicals and mixtures thereof and $R^1$ is an alkyl radical is mixed with a compound of the formula $$R_2Si_2(OCH_3)_4$$

in which R is the same as above.

3. A process for preparing a protective coating containing silicon carbide, which comprises applying a coating composition containing a copolymer obtained by reacting at least one disilane of the formula $$R_2R^1Si_2(OCH_3)_3$$

in which R is selected from the group consisting of alkyl, alkenyl, aryl radicals and mixtures thereof and $R^1$ is an alkyl radical with at least one compound of the formula $$R_2R^2SiH$$

in which R is the same as above and $R^2$ is selected from the group consisting of a methoxy radical and R in the presence of at least one compound of the formula $$MOR$$

in which R is the same as above and m is an alkali metal, a compound of the formula $$HO[(R^1R^3SiO)_x(R^1{}_2SiO)_y]_nH$$

in which $R^1$ is the same as above, $R^3$ is an alkenyl radical, x is in the range of from 0.5 to 1.5 y is in the range of from 3 to 5 and n is in the range of from 500 to 2,000 and a compound of the formula $$[(R^1{}_3SiO)_a(R^1{}_2R^3SiO)_b(SiO_2)_c]_d$$

in which $R^1$ and $R^3$ are the same as above, a is in the range of from 0.3 to 0.4, b in the range of from 0.01 to 0.1, c is in the range of from 0.5 to 0.7 and d is in the range of from 10 to 100 and silicon carbide having an average particle size range of from 0.5 to 10 μm to a substrate and thereafter pyrolyzing the coating in an inert atmosphere or in vacuo.

4. The process of claim 3, wherein the disilane of the formula $$R_2R^1Si_2(OCH_3)_3$$

in which R is selected from the group consisting of alkyl, alkenyl, aryl radicals and mixturs thereof and $R^1$ is an alkyl radical is mixed with a compound of the formula $$R_2Si_2(OCH_3)_4$$

in which R is the same as above.

5. The process of claims 1, 2, 3 or 4, wherein the substrate is a metallic substrate.

* * * * *